United States Patent [19]

Humphries

[11] Patent Number: 4,471,903

[45] Date of Patent: Sep. 18, 1984

[54] ARTICLE CARRIER OF THE WRAPAROUND TYPE

[75] Inventor: Richard L. Humphries, Sunnyvale, Calif.

[73] Assignee: Certipak Corporation, Greenwich, Conn.

[21] Appl. No.: 450,524

[22] Filed: Dec. 17, 1982

[51] Int. Cl.[3] ..... B65D 5/04; B65D 85/00

[52] U.S. Cl. ..... 229/40; 206/427; 206/434

[58] Field of Search ..... 206/139, 140, 171, 172, 206/173, 427, 434; 229/40, DIG. 3; 217/3 C, 3 FC

[56] References Cited

U.S. PATENT DOCUMENTS

| | | | |
|---|---|---|---|
| 2,004,098 | 6/1935 | Andrews | 24/17 |
| 3,374,938 | 3/1968 | Pierce, Jr. | 229/40 |
| 3,410,397 | 11/1968 | Cato | 206/65 |
| 3,508,699 | 4/1970 | Graser | 229/40 |
| 4,243,143 | 1/1981 | Muller | 206/429 |

*Primary Examiner*—William Price
*Assistant Examiner*—Gary E. Elkins
*Attorney, Agent, or Firm*—King and Liles

[57] ABSTRACT

An article carrier is formed from an elongated blank having overlapping bottom panels to support articles in at least one row. One of the bottom panels has a plurality of spaced tongues at its terminal end. A plurality of separate locking tabs are longitudinally aligned with each tongue. The other of the bottom panels has transversely elongated apertures with each of the apertures receiving one of the tongues. Each of the tongues has engagement with one transverse edge of the aperture and one of the plurality of separate locking tabs has an edge to edge overlying engagement with the opposite transverse edge of the aperture. Each of the apertures is increased in size in accordance with which of the separate locking tabs overlies the opposite transverse edge of the aperture. Each of the separate locking tabs are selected for use in accordance with the dimensions of the adjacent article or articles supported by the carrier.

6 Claims, 8 Drawing Figures

ARTICLE CARRIER OF THE WRAPAROUND TYPE

TECHNICAL FIELD

This invention relates to an article carrier of the wraparound type and, more particularly, to an article carrier of the wraparound type for packaging a plurality of articles in at least one row with the carrier being formed from a blank having overlapping panels secured by adjustable separate locking tabs engaged in accordance with the dimensions of the article or articles being packaged.

BACKGROUND ART

U.S. Pat. No. 3,374,938 to Pierce, Jr., assigned to the present assignee, is directed to an article carrier of the wraparound type in which the bottom panels are secured in overlapping relation. A plurality of tongues on one of the bottom panels is disposed in corresponding transversely elongated apertures in the other of the bottom panels. Each of the tongues has a locking tab longitudinally aligned therewith for disposition in the same transversely elongated aperture as the tongue with which the locking tab is longitudinally aligned. Each of the tongues is threaded into position to have an edge to edge engagement with a transverse edge of the corresponding aperture. Each locking tab after being punched into position has an edge to edge engagement with the opposite transverse edge of the aperture to lock the overlapping bottom panels of the elongated blank to form the carrier.

The carrier of the present invention is an improvement of the Pierce '938 patent in that it obtains the edge to edge relation along the two opposite transverse edges of the transversely elongated apertures while being capable of accommodating articles of varying dimensions.

If the dimensions of the articles such as bottles, for example, vary considerably in size because of failure of the bottle manufacturer to control size uniformity, the prior art carriers do not have a tight wrap around all of the bottles as is desired. Thus, while the carrier of the Pierce '938 patent provides a very strong and satisfactory article carrier due to the double edge contact relationship between the tongues, the locking tabs, and the aperture edges, there are situations in which the dimensions of the articles are so non-uniform that a tight wrap cannot be obtained.

The adaptability of an article carrier of the wraparound type to articles of varying dimensions is shown and described in U.S. Pat. No. 3,410,397 to Cato, U.S. Pat. No. 3,508,699 to Graser, and U.S. Pat. No. 4,243,143 to Muller. An adjustable wraparound band for a bakery product is shown and described in U.S. Pat. No. 2,004,098 to Andrews.

The aforesaid Cato patent '397 discloses an adjustable carrier of the wraparound type in which a very small area of contact is obtained between curved ends of a locking tab and the longitudinal edges of the aperture through which the locking tab extends. Because of the very small and indirect engagement areas between the overlapping panels, the reliability of the locking engagement leaves much to be desired.

Additionally, the adjustability of the closure panel in the aforesaid Cato patent '397 is limited. This is because the locking tab is a single element movable into a variable aperture created by a bendable friction tab and capable of only slight adjustment in size.

The article carrier of the Graser patent '699 uses a punch tab for engagement with the longitudinal sides of rectangularly shaped cut-out apertures. This also has the disadvantage of being limited in the amount of adjustment and the lack of a substantially large and direct edge contact area for locking areas, as obtained in the Pierce '938 patent.

The carrier of the Muller patent '143 has a locking aperture to receive a locking tab. There is contact of only one edge of each of the tabs with the locking aperture. Again, the desired relatively large area of direct edge to edge engagement of the Pierce patent is missing.

DISCLOSURE OF THE INVENTION

The article carrier of the present invention has the advantage of the relatively large and direct edge to edge engagement areas obtained in the Pierce patent '938 while still being adjustable in accordance with the dimensions of the article or articles within the carrier. In particular, the carrier of the present invention is able to obtain the relatively large edge to edge locking engagement areas on opposite sides of an aperture through which locking tabs extend. In addition, direct engagement of the edges on opposite sides of the aperture are obtained. The engagement is more secure since the holding force is not limited to two corners of a tab or the like as in the prior art. At the same time, the present carrier is uniquely adjustable in accordance with the dimensions of the article or articles carried thereby.

The carrier of the present invention accomplishes this through utilizing elongated transverse apertures of the type shown in the Pierce patent '938 and combined insertable tongues and locking tabs for the apertures, both of which are adjustable. Specifically, the carrier of the present invention utilizes an arrangement in which the length of each of the apertures can be increased to accommodate the tongues in accordance with the dimensions of the article or articles carried thereby. With respect to the locking tabs for use with the apertures, there is formed a plurality of separate in-line locking parts or tabs for disposition within the transversely elongated aperture also in accordance with the dimensions of the article or articles carried thereby. Thus, the carrier of the present invention has a tight, snug wraparound arrangement with the article or articles carried thereby, as will be seen more in detail below.

Thus, a main object of this invention is to provide an article carrier to accommodate articles of various widths while still having secure support across the entire base of the carrier.

Other objects of this invention will be readily perceived from the following description, claims, and drawings.

This invention relates to an article carrier of the wraparound type for packaging a plurality of articles in at least one row including an elongated blank having fold lines to form panels including closure panels designed to overlap when applied to the articles to be packaged. One of the closure panels has a plurality of locking means spaced from each other transversely of the blank with the locking means being disposed adjacent the edge thereof. The locking means may be combined tongues and tabs constituting at least a portion of the panel. The other of the closure panels has a plurality of transversely elongated apertures therein adjacent the terminal edge with each of the transversely elongated apertures receiving one of the locking means when the closure panels are in overlapping relation for locking. Each of the transversely elongated apertures has a first transverse edge adjacent the terminal edge of the pahel and a second transverse edge opposite the first transverse edge.

More specifically, with respect to the locking means, a tongue or first portion is insertable within each of the transversely elongated apertures and overlying the second transverse edge. Next, a selected tab or second portion is punched into or insertable within each of the transversely elongated apertures and overlying the first transverse edge of the aperture. A locking edge to edge engagement is obtained when the second portion is inserted within the aperture.

One of the first and second portions of each of the locking means has a plurality of separate tabs for overlying the corresponding transverse edges in the desired adjusted position in edge to edge engagement. It will be seen that one of the plurality of the separate tabs is selected for the edge to edge engagement in accordance with the dimensions of the article or articles adjacent thereto. The other closure panel has means to control the area of each of the transversely elongated apertures to receive the tongue in accordance with the selected one of the tabs.

In the-preferred embodiment, one closure panel has a plurality of sets of locking tabs formed therein with each of the sets of locking tabs being in longitudinal alignment with one of the tongues. Each of the tongues overlies the second transverse edge when the tongue is inserted into the aperture to form an edge to edge contact between the closure panels. Each of the sets of locking tabs has a selected one of the locking tabs overlying the first transverse edge of each of the apertures so as to have an edge to edge engagement between the locking tab and the other closure panel. The selected locking tab of each of the sets of locking tabs is punched into position in accordance with the dimensions of the article or articles. Maximum insertion of each of the tongues in each of the transversely elongated apertures is obtained with the proper tab holding the panels together thereby providing maximum strength and security of the carrier.

BRIEF DESCRIPTION OF THE DRAWINGS

The attached drawings illustrate a preferred embodiment of the invention, in which:

Referring to the drawings and particularly FIG. 2, there is shown an article carrier 10 of the wraparound type for a plurality of articles such as bottles 11, for example, arranged in one or more rows. As shown in FIG. 2, the bottles 11 are arranged in two rows, but there could be only a single row or more than two rows.

The article carrier 10 is formed from an elongated blank 12 (see FIG. 1) of a suitable foldable sheet material such as paperboard, for example. The elongated blank 12 has a single top panel with circular apertures 15 cut therein to accommodate the necks of the bottles 11 (see FIG. 2).

Figure 1:
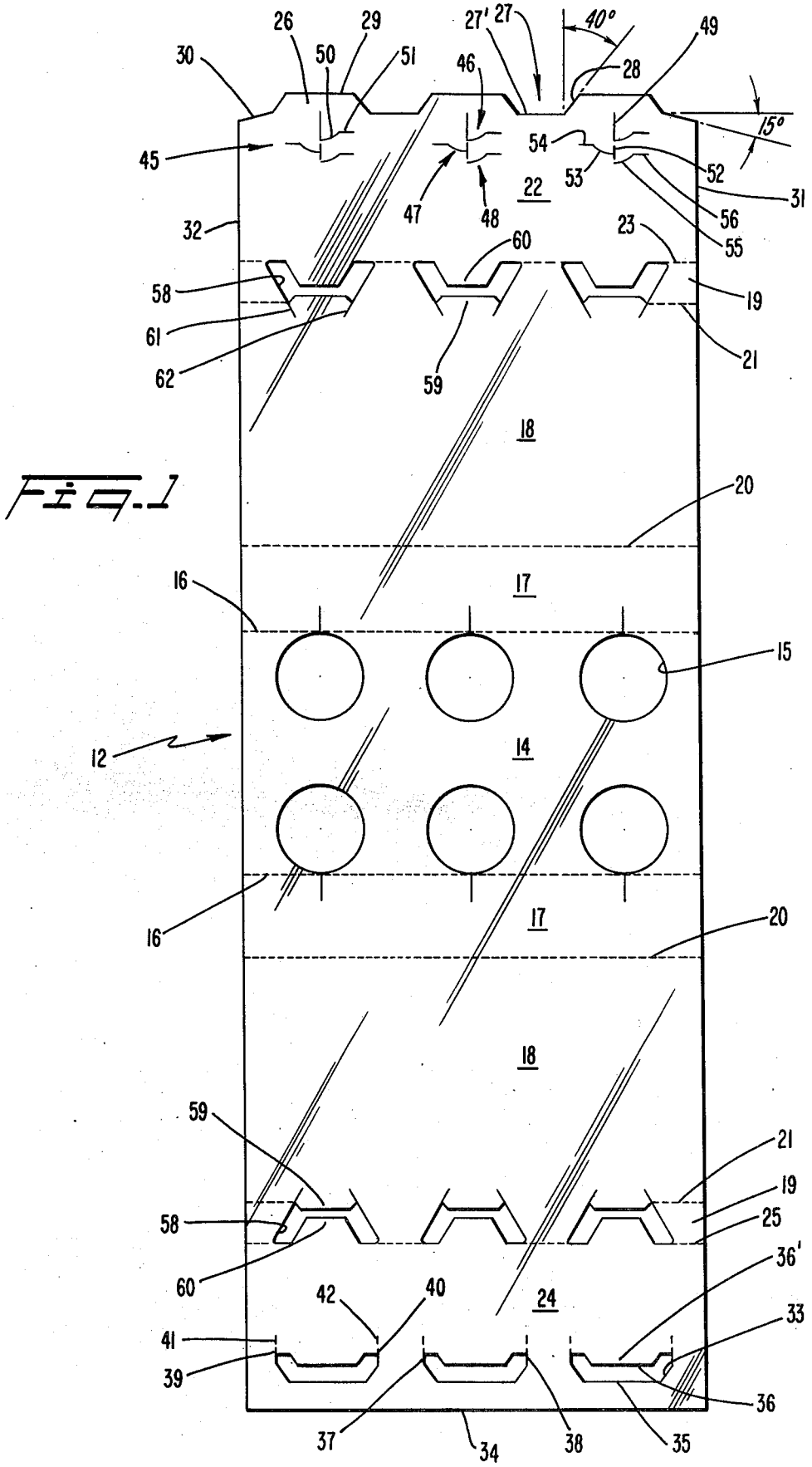
FIG. 1 is a top plan view of an elongated blank from which an article carrier of the present invention is formed.
Figure 2:
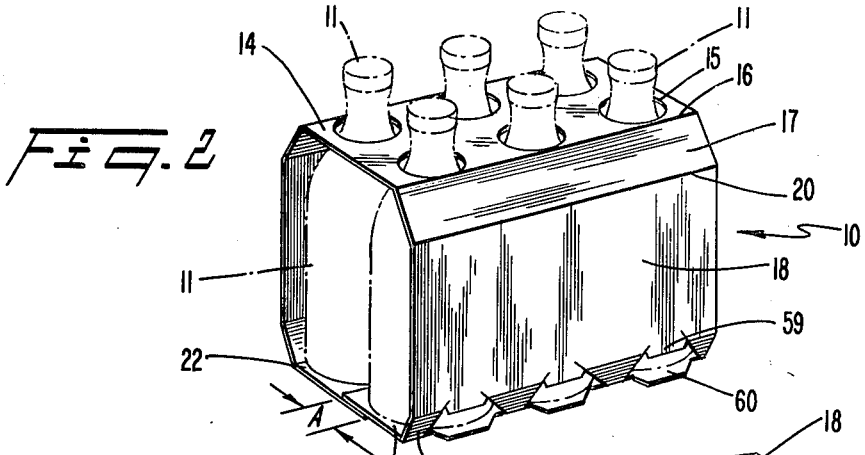
FIG. 2 is a perspective view of the article carrier of the present invention having a plurality of articles, such as bottles, supported thereby after completion of forming the blank as the carrier.

A side panel assembly or structure is articulated or hingedly joined to opposite sides of the top panel 14 (See FIGS. 1 & 2) along a pair of top fold lines 16 and comprises an angled upper side panel 17, a central intermediate side panel 18, and an angled lower side panel 19 on each side. The central side panel 18 is designed to be substantially vertical in the completed article carrier 10, as shown in FIG. 2. The upper side panel 17 assumes an inward slant towards the top panel 14 and the lower side panel 19 assumes an inward slant towards the bottom of the carrier 10. The angular disposition of the side panels 17, 18, and 19 is facilitated by transverse fold lines 20 between the side panels 17 and 18 and transverse fold lines 21 between the side panels 18 and 19. It should be noted that the fold lines 21 need not be continuous.

A bottom or closure panel 22 is articulated or hingedly joined to one of the side panels 19 along a fold line 23. Another bottom or closure panel 24 is articulated or hingedly joined to the other of the side panels 19 by a fold line 25.

The bottom panel 22 has a plurality of transversely spaced tongues 26 (three shown in FIG. 1) with the number of the tongues 26 being equal to the number of the bottles 11 (see FIG. 2) in each of the rows. The tongues 26 (see FIG. 1) are spaced from each other by recessed edge portions 27 between the tongues 26. Each of the recessed edge portions 27 has a base 27' and inclined portions 28 extending from the base 27' and disposed at an angle of 40° to edge 29 of the tongue 26.

The outer ends of the outermost of the tongues 26 are connected by an edge 30 to longitudinal side edges 31 and 32 of the elongated blank 12. The edges 30 are an angle of 15° to a horizontal line passing through the base 27' of each of the recessed edge portions 27. The bottom panel 22 has its terminal edge defined by the edges 29 of the tongues 26, the recessed edge portions 27, and the connecting edges 30.

The bottom panel 24 has a plurality of transversely elongated apertures 33 formed therein adjacent terminal edge 34 of the bottom panel 24. Each of the transversely elongated edges 33 has a first transverse edge 35 adjacent the terminal edge 34 of the bottom panel 24 and substantially parallel thereto and a second transverse edge 36 opposite the first transverse edge 35 and substantially parallel thereto as shown in FIG. 1. The second transverse edge 36 borders an internal tab 36'. Each of the transversely elongated apertures 33 also includes a pair of substantially parallel longitudinal edges 37 and 38.

The bottom panel 24 is slit to have a first pair of substantially longitudinal perforated slits 39 and 40 therein forming a continuation of the longitudinal edges 37 and 38 of each of the transversely elongated apertures 33 so as to be in substantial longitudinal alignment therewith. The bottom panel 24 also is slit to have a pair of longitudinal perforated slits 41 and 42 therein slightly spaced longitudinally from the perforated slits 39 and 40, respectively, and in substantial longitudinal alignment therewith.

Each of the tongues 26 is insertable into one of the transversely elongated apertures 33 only when the bottom or closure panels 22 and 24 are in overlapping relation. The tongue overlies the second transverse edge 36 of the aperture 33 so as to have a relatively large area of overlapping contact therebetween. The number of the transversely elongated apertures 33 is equal to the number of the tongues 26.

The bottom panel 22 has a set generally designated by the reference numeral 45, of locking parts longitudinally aligned with each of the tongues 26 and in line with each other. As shown in FIG. 1, each of the sets 45 includes three locking parts, preferably tabs 46, 47, and 48. The locking tabs 46–48 are longitudinally spaced from each other so as to be separate from each other and are formed through slitting the bottom panel 22.

The outermost locking tab 46 is formed by a longitudinal slit 49, a curved slit 50 at the inner end thereof, and a transverse slit 51 connected to the end of the curved score line 50. The next or middle locking tab 47 of the set is formed by a longitudinal slit 52, a curved slit 53 connected perpendicularly to the longitudinal slit 52 intermediate its ends, and a transverse slit 54 connected to the end of the curved slit 53. Each transverse slit 54 is aligned in the transverse direction with the outer end of the longitudinal slit 52.

The innermost locking tab 48 is formed by a curved slit 55 extending from an imaginary line containing the longitudinal slits 49 and 52 and a transverse slit 56 extending from the end of the curved slit 55. The transverse slit 56 is in substantial alignment in the transverse direction with the end of the curved slit 53 at its junction with the longitudinal slit 52.

Figure 3A:
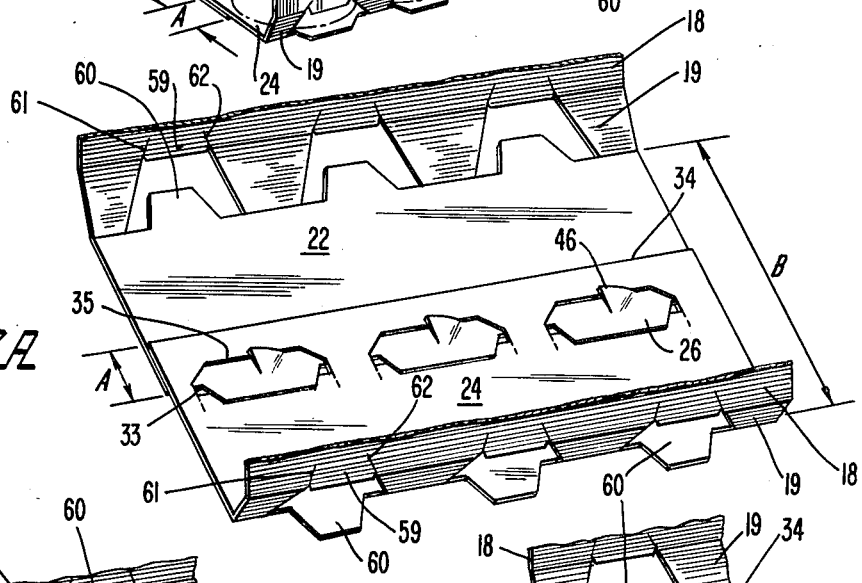
FIG. 3A is a fragmentary inside perspective view of the carrier showing the relation of the bottom panels of the blank when there is a minimum overlap for the maximum width of the articles.

When the elongated blank 12 is folded to form the carrier 10 (see FIG. 2) with the bottles 11 therein, the bottom panels 22 and 24 are in an overlapping relation. As shown in FIGS. 3A and 4A, the overlap, which is identified by A, is a minimum in comparison with the overlap A in FIGS. 3B and 4B. The overlap A in FIGS. 3C and 4C is even more than in FIGS. 3B and 4B.

When the overlap A is a minimum as shown in FIGS. 3A and 4A, the bottom panels 22 and 24 are adjusted to accommodate the widest width of the bottles 11 (see FIG. 2) as indicated by dimension B (see FIG. 3A). The dimension B is smaller in FIG. 3B than the dimension B in FIG. 3A while the minimum dimension B is shown in FIG. 3C where the overlap A is a maximum.

When the tongue 26 is inserted within the transversely elongated aperture 33, the tongue overlies the second transverse edge 36 as shown in FIG. 4A. In this position, the locking tab 46 of the set overlies and engages in edge to edge locking engagement a portion of the first transverse edge 35 of the aperture 33. This is for the overlap A being a minimum and the dimension B, which represents the support width distance for the bottles 11 (see FIG. 2), being a maximum.

Figure 3B:
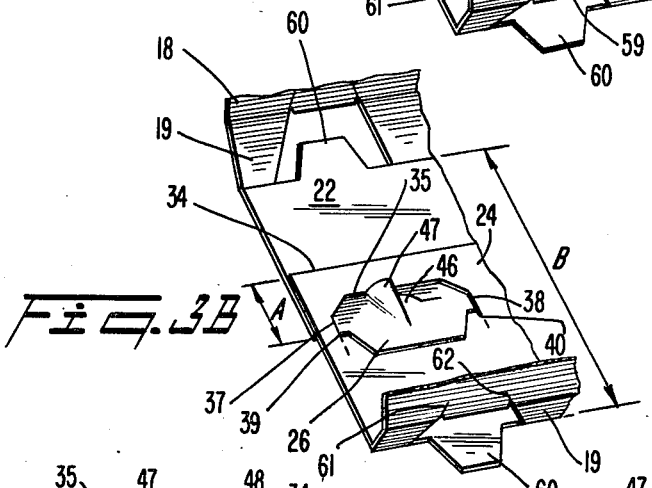
FIG. 3B is a fragmentary inside perspective view, similar to FIG. 3A, showing the relation of the bottom panels when there is an intermediate overlap for an intermediate width of the articles.
Figure 3C:
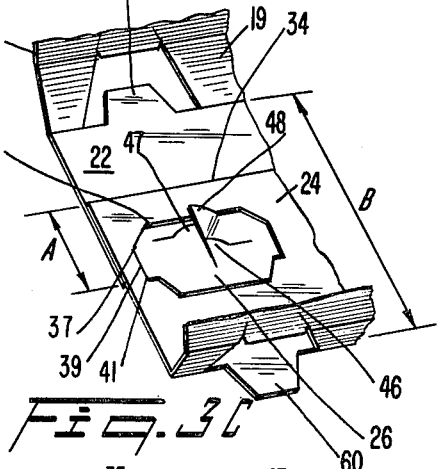
FIG. 3C is a fragmentary inside view, similar to FIGS. 3A and 3B, showing the relation of the bottom panels when there is a maximum overlap for the minimum width of the articles.
Figure 4A:
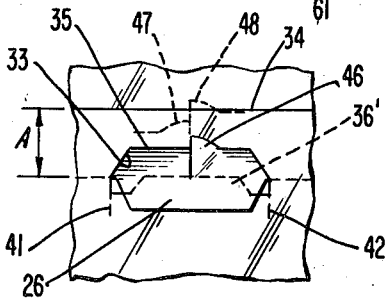
FIG. 4A is an enlarged fragmentary inside plan view showing in more detail the relationship of FIG. 3A for the locking tabs and the tongue within the transversely elongated aperture of the blank.
Figure 4B:
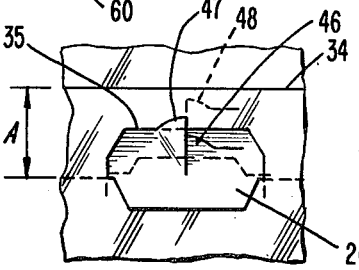
FIG. 4B is a similar fragmentary plan view showing the relationship of FIG. 3B for the locking tabs and the tongue within the transversely elongated aperture of the blank; and FIG, 4C is a similar fragmentary plan view showing the relationship of FIG. 3C for the locking tabs and the tongue within the transversely elongated aperture of the blank.
Figure 4C:
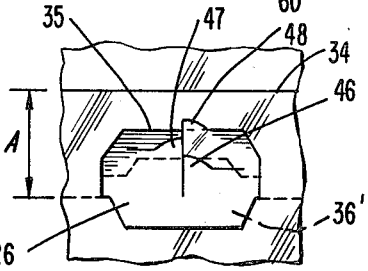

When the bottles 11 are not as wide so that the overlap A and the dimension B are that shown in FIGS. 3B and 4B, the tongue 26 is inserted into the transversely elongated aperture 33 and the longitudinal slits 39 and 40 are used to increase the depth of each of the apertures 33. This enables the locking tab 47 to overlie the transverse edge 35 of the aperture 33 as shown in FIGS. 3B and 4B. Thus, the increased area of the transversely elongated aperture 33 enables the locking tabs 46 and 47 to be inserted within the transversely elongated aperture 33 so that the second locking tab 47 is the part of the locking means used. As shown in FIG. 4B, the bridge of material of the bottom panel 22 is ruptured between the longitudinal slit 49 of the locking tab 46 and the longitudinal slit 52 of the locking tab 47 so that a continuous slit exists and the tab 47 can be used.

When the article support dimension B is a minimum (minimum size articles) as shown in FIG. 3C, aperture 33 is enlarged through utilization of the longitudinal slits 41 and 42 to enable further entry of the tongue 26. When this occurs, the bridge portions of the bottom panel 24 between the slits 39 and 41 and the longitudinal slits 40 and 42, respectively, are ruptured so that the tongue 26 may enter a maximum amount. This is shown in FIG. 4C.

In this position of the maximum overlap A, the locking tab 48 overlies the first transverse edge 35 of the transversely elongated aperture 33. Thus, the area of contact between the tongue 26 and the internal tab 36' is a maximum.

Each of the lower side panels 19 (see FIG. 1), which is defined between the fold lines 21 and 23, has relief apertures 58 with each of the relief apertures 58 being in longitudinal alignment with one of the tongues 26. Each of the relief apertures 58 is shaped to provide a pair of oppositely pointing internal tongues 59 and 60, which are not transversed by any of the fold lines 21, 23, and 25. A pair of slits 61 and 62 converge towards each other to enable each of the tongues 59 to be moved outwardly to a degree in accordance with the dimensions of the bottles (see FIG. 2) while allowing the corresponding tongue 60 to support the outer edge bottom of the bottle 11.

In forming the carrier 10 from the elongated blank 12 (see FIG. 1), the elongated blank 12 is first placed over the necks of the bottles 11 (see FIG. 2). With the elongated blank 12 disposed with the top panel 14 horizontal, the side panels 17, 18, and 19 are folded down the sides of the two rows of the bottles 11 (see FIG. 2).

Then, the bottom panels 22 (see FIG. 1) and 24 are folded under the bottoms of the bottles 11 (see FIG. 2). The tongues 26 (see FIG. 1) are threaded into the transversely elongated apertures 33, and one or more of the locking tabs 46–48 is inserted into the longitudinal aligned, transversely elongated aperture 33 by punching in accordance with the dimension B at that particular position (see FIG. 3A). Normally, the same number of the locking tabs 46–48 (see FIG. 1) are disposed in each of the transversely elongated apertures 33 with which it cooperates so that the same tab is performing the locking function. This depends upon the article support dimension B (see FIG. 3A) as determined by the two adjacent bottles 11 (see FIG. 2).

When the overlap A is greater than that shown in FIGS. 3A and 4A, the area of the transversely elongated aperture 33 is increased through insertion of the tongue 26 (see FIG. 4B) into the bottom of the slits 39, 40. Next the middle one of the locking tabs 47 is punched into the transversely elongated aperture 33 in locking position. This action enables bending of the internal tab 36' so that the tongue 26 may further overlie the area of the bottom panel 24 with which it is in engagement. The edge of slit 54 of the locking tab 47 engages edge 35 for a secure locking relationship.

If the overlap A is a maximum as shown in FIGS. 3C and 4C, then the internal tab 36' is even larger in that the longitudinal slits 41 and 42 are opened to increase the area of the transversely elongated aperture 33. This occurs when all three of the locking tabs 46–48 are inserted into the transversely elongated aperture 33 and the locking tab 48 overlies and engages in edge to edge contact with the transverse edge 35 of the aperture 33.

During erection of the carrier 10 (see FIG. 2) from the elongated blank 12 (see FIG. 1), the tongue 26 is initially threaded underneath the tab 36'. During threading, the locking tabs 46–48 are on the opposite side (bottom) of the bottom panel 24 from the tongue 26. Then, depending on the length of the overlap A (see FIG. 3C), the locking tab 46, the locking tabs 46 and 47, or the locking tabs 46, 47, and 48 are forced or punched past the transverse edge 35. The number of the locking tabs 46–48 forced past the first transverse edge 35 of the transversely elongated aperture 33 depends upon the length of the overlap A.

The inserting of the tongue 26 and the forcing of the locking tab 46, the locking tabs 46 and 47, or the locking tabs 46, 47, and 48 into the locking position determines the size of the aperture 33. That is, the area of the aperture 33 increases as the number of the locking tabs 46–48 forced into the aperture 33 increases.

The locking arrangement of the present invention enables a relatively large edge to edge engagement in a transverse direction while still obtaining adjustability in accordance with the width of the bottles 11 (see FIG. 2). Thus, the carrier 10 may be utilized when the bottles 11 are of non-uniform size.

There is obtained a firm and secure locking engagement with each of the transverse edges 35 (see FIG. 1) and 36 of the transversely elongated aperture 33 through which the locking means extends. This locking engagement provides a relatively large contact area while still having the desired adjustability.

While the present invention has shown the bottles 11 (see FIG. 2) as being the articles, it should be understood that the carrier 10 may be used with any type of articles as long as there is at least one row thereof. Thus, the articles could be cans, for example, and the blank 12 (see FIG. 1) would be formed without the apertures 15 in the top panel 14. Also, the relief apertures 58 may be omitted if desired.

While there have been shown three of the locking tabs 46–48 forming each of the sets 45 of locking tabs, it should be understood that each could have instead any desired number of locking tabs.

The number of the pairs of longitudinal slits 39, 40 for eadh of the transversely elongated apertures 33 is preferably one less than the number of the locking tabs. Thus, an increase in the number of the locking tabs in each of the sets 45 requires an increase in the number of the pairs of longitudinal slits.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

What is claimed is:

1. An article carrier of the wraparound type of sheet material for packaging a plurality of articles in at least one row including an elongated blank having fold lines to form panels including closure panels designated to overlap when applied to the articles to be packaged, one of said closure panels having a plurality of locking means spaced from each other transversely of said blank, the other of said closure panels having a plurality of transversely elengated apertures therein, each of said transversely elongated apertures receiving one of said locking means when said closure panels are in overlapping relation to lock said closure panels to each other, each of said transversely elongated apertures having a first transverse edge on the side of said transversely elongated aperture adjacent the terminal edge of said other closure panel and a second transverse edge opposite said first transverse edge, each of said locking means inlcuding a first portion insertable within each of said transversely elongated apertures and overlying said second transverse edge, and a second portion overlying said first transverse edge of said aperture in an edge to edge engagement, one of said first and second portions of each of said locking means having a plurality of separate locking parts for overlying one said first and second transverse edges in edge to edge engagement, the parts being selected for the edge to edge locking engagement being in accordance with the dimensions of the article or articles adjacent thereto, and said other closure panel having means to control the area of each of said transversely elongated apertures to allow receipt of and locking engagement with the selected one of said separate locking parts.

2. The article carrier according to claim 1 in which said second portion of each of said locking means includes said plurality of separate parts.

3. The article carrier according to claim 2 in which said plurality of separate parts of said second portion of each of said locking means comprises at least three separate locking tabs spaced longitudinally from the terminal edge of said one closure panel.

4. The article carrier according to claims 2 or 3 in which each of said transversely elongated apertures includes a pair of opposed longitudinal edges; a first of said locking tabs of each of said locking means being insertable within each of said transversely elongated apertures; and said control means of said other closure panel includes a first pair of substantially longitudinal slits in said other closure panel forming an extension of said transversely elongated aperture to enable an increase in the area to accommodate a second of said locking tabs of each of said locking means in addition to said first locking tab; and at least one additional pair of substantially longitudinal slits in substantial longitudinal alignment with each of said first pair and spaced slightly therefrom by a rupturable material bridge in the longitudinal direction to enable a further increase in the area of each of said apertures to accommodate a third of said locking tabs.

5. An article carrier of the wraparound type of sheet material for packaging a plurality of articles in at least one row including an elongated blank having fold lines to form panels including closure panels designed to overlap when applied to the articles to be packaged, one of said closure panels having a plurality of tongues spaced from each other transversely of said blank and recessed edge portions between said spaced tongues, the edges of said tongues and said recessed edge portions constituting the terminal edge of said one closure panel, the edges of said tongues being substantially in line, the other of said closure panels having a plurality of transversely elongated apertures therein adjacent the terminal edge of the other of said closure panels, each of said transversely elongated apertures having one of said tongues insertable therein when said closure panels are in an overlapping relation, a first transverse edge on the side of said transversely elongated aperture adjacent the terminal edge of said other closure panel and a second transverse edge oposite said first transverse edge, said one closure panel having a plurality of sets of locking tabs formed therein, each of said sets of locking tabs being in longitudinal alignment with one of said tongues, each of said tongues overlying said second transverse edge of said aperture when said tongue is inserted and each of said sets of locking tabs having a selected one of said locking tabs overlying said first transverse edge so as to have an edge to edge engagement between said locking tab and said other closure panel, each of said transversely elongated apertures further including a pair of opposed longitudinal edges; a first of said locking tabs of each of said sets of locking tabs being insertable within each of said transversely elongated apertures; and said other closure panel having a first pair of substantially longitudinal slits forming an extension of said longitudinal edges to enables an increase in the area to accommodate a second of said locking tabs; and at least one pair of additional substantially longitudinal slits in substantial longitudinal alignment with each of said first pair of slits and spaced slightly therefrom by a rupturable material bridge in the longitudinal direction to enable a further increase in the area of each of said apertures to accommodate a third of said locking tabs, said selected locking tab of each of said sets of locking tabs being selected from said first, second and third locking tabs in accordance with the dimensions of the article or articles adjacent thereto so that the maximum insertion of each of said tongues in each of said transversely elongated apertures is obtained.

6. An article carrier of the wraparound type of sheet material for packaging a plurality of articles in at least one row including an elongated blank having fold lines to form panels including closure panels designed to overlap when applied to the articles to be packaged, one of said closure panels having a plurality of tongues spaced from each other transversely of said blank and recessed edge portions between said spaced tongues, the edges of said tongues and said recessed edge portions constituting the terminal edge of said one closure panel, the edges of said tongues being substantially in line, the other of said closure panels having a plurality of transversely elongated apertures therein adjacent the terminal edge of the other of said closure panels, each of said transversely elongated apertures having one of said tongues insertable therein when said closure panels are in an overlapping relation, a first transverse edge on the side of said transversely elongated aperture adjacent the terminal edge of said other closure panel and a second transverse edge opposite said first transverse edge, said one closure panel having a plurality of sets of locking tabs formed therein, each of said sets of locking tabs being in longitudinal alignment with one of said tongues, each of said tongues overlying said second transverse edge of said aperture when said tongue is inserted and each of said sets of locking tabs having a selected one of said locking tabs overlying said first transverse edge so as to have an edge to edge engagement between said locking tab and said other closure panel, said other closure panel further including means to enable an increase in area of each of said transversely elongated apertures to allow receipt of and locking engagement with the selected locking tab, said selected locking tab of each of said sets of locking tabs being selected in accordance with dimensions of the article or articles adjacent thereto so that the maximum insertion of each of said tongues in each of said transversely elongated apertures is obtained.

* * * * *